United States Patent [19]

Winn

[11] 3,995,078

[45] Nov. 30, 1976

[54] REMOVAL OF SURFACE ACCUMULATIONS OF TREATING AGENTS AND WOOD RESINS

[75] Inventor: William D. Winn, Lake Jackson, Tex.

[73] Assignee: The Dow Chemical Company, Midland, Mich.

[22] Filed: Apr. 17, 1974

[21] Appl. No.: 461,575

[52] U.S. Cl. ..... 427/352; 134/42; 8/6.5; 34/9.5; 34/13.8; 34/16.5; 252/380; 252/387; 427/335; 427/440

[51] Int. Cl.[2] ..... B05D 3/00

[58] Field of Search ..... 117/102 A, 102 R, 57, 117/59, 147, 62, 63; 21/7; 427/325, 345, 335, 440, 336, 352; 8/6.5; 34/9.5, 13.8, 16.5; 134/42; 252/380, 387

[56] References Cited

UNITED STATES PATENTS

| | | | |
|---|---|---|---|
| 2,430,641 | 11/1947 | Mackenzie et al. | 427/352 X |
| 2,650,885 | 9/1953 | Hudson | 117/147 |
| 2,860,070 | 11/1958 | McDonald | 117/59 |
| 3,039,843 | 6/1962 | Chamberlain | 21/7 |
| 3,200,003 | 8/1965 | Bescher | 117/59 |
| 3,376,144 | 4/1968 | Stutz | 106/15 AF |
| 3,658,575 | 4/1972 | Tabor et al. | 117/102 R |
| 3,677,805 | 7/1972 | Barnett | 21/7 |
| 3,685,959 | 8/1972 | Dunn et al. | 117/147 |
| 3,785,770 | 1/1974 | Hudson | 117/102 R |

*Primary Examiner*—Michael R. Lusignan
*Attorney, Agent, or Firm*—Glwynn R. Baker

[57] ABSTRACT

Surface accumulation of crystalline treating agents, such as pentachlorophenol, and water insoluble extracted wood resins, developed during solvent removal after pressure impregnation, and readily removed by contacting the so treated wood while still in a heated condition with liquid solvent thereby causing ebullient boiling of the solvent at the surface effecting a cleaning action and dissolution of the removed crystalline agent in the body of the solvent. If the solvent is contacted with the hot surface and removed immediately following cessation of ebullient boiling no additional post treatment is necessary to remove solvent from the surface of the wood. If desired a light (short duration) post steaming, however, may be employed without adverse effect, i.e., bringing more treating agent to the surface which would again permit crystallization of the agent at the surface.

4 Claims, No Drawings

REMOVAL OF SURFACE ACCUMULATIONS OF TREATING AGENTS AND WOOD RESINS

BACKGROUND OF THE INVENTION

Recent developments in the wood treating industry requiring clean treated wood products have revived solvent treating processes. In each of these processes, as well as the conventional oil processes, removal of solvent or in the case of the oil treatment the removal of surface oil, brings to the surface of the wood the treating agent and normally leaves the agent on the surface. Previous practice in the industry has been to brush the surface with stiff brushes. This practice, however, is time consuming and creates dust problems in the work area. Therefore, in order to eliminate the conventional post treatment clean-up and reduce the handling of wood treated with, for example, pentachlorophenol, the following procedure was discovered.

BRIEF DESCRIPTION OF THE INVENTION

In accordance with the present invention wood treated by impregnation under pressure with a solution or dispersion of a wood treating agent, such as a preservative, e.g., pentachlorophenol, or fire retardant chemical, in an organic solvent, oil or liquid petroleum gas (LPG) in a process which includes a post impregnation heating step to remove the solvent, surface oil or LPG, is subjected to contact with a halogenated aliphatic solvent while the wood is still hot. The solvent on contacting the hot wood undergoes ebullient boiling, scouring the surface of the wood thereby removing by dissolving from the surface any crystalline treating agent at the surface. The so removed agent is dissolved or dispersed in the liquid solvent adjacent the solvent ebullient boiling at the surface. If the solvent is removed from contact with the wood before or immediately after ebullient boiling ceases, and no appreciable amount of pressure is allowed to develop, no post steaming is necessary to remove the solvent which may enter the wood since that remaining on the surface is vaporized almost immediately. However, if the wood is permitted to remain in contact with the solvent for any appreciable period of time after cessation of ebullient boiling and/or appreciable pressure is allowed to develop which causes liquid solvent to flow into the wood, then a post steaming to remove and recover this solvent should be practiced.

Good results have been achieved when practicing the present invention by employing the chlorinated hydrocarbon solvents such as methylene chloride, 1,1,1-trichloroethane, trichloroethylene and perchloroethylene, the selection of solvent depending upon the temperature of the wood at the time of contact with the solvent, it being necessary that the solvent boil at the temperature of the wood. It has been found particularly advantageous to employ methylene chloride. Other organic solvents such as methanol, acetone and toluene could be employed but generally possess one or more physical or chemical properties which require special precautions when employed in accordance with the present invention. Therefore, the use of other than chlorinated solvents is not recommended.

The crystalline and solvent soluble or dispersible treating agents or wood resins (also insoluble matter which may adhere to the wood surface via solvent soluble residues), can be effectively removed from the surface of the treated wood by employing the procedures of the present invention. For example, in addition to pentachlorophenol, it is possible to clean the surface of wood treated with fire retardant agents, dimensional stabilizer polymers, water repellent agents, and the like.

DETAILED DESCRIPTION OF THE INVENTION

In accordance with the present invention wood utility poles are loaded into a treating cylinder, the cylinder closed and a solution of methylene chloride containing 5% by weight pentachlorophenol pumped into the cylinder. The cyliner is vented until the liquid solvent has filled the cylinder at which time the vent is closed and the pressure allowed to build up as more liquid is introduced into the cylinder by the pump. The pressure build-up in the cylinder is cyclic because solvent and penta are being pressured into the wood. Once the desired pressure is built up to introduce the correct amount of penta into the wood, in this instance a ½ pound penta per cubic foot, necessitating impregnating ten pounds of solvent into each cubic foot of wood, the pressure is released, the excess solvent drained from the cylinder and the wood is steamed with live, saturated atmospheric pressure steam, until the major portion of solvent is removed. The wood will reach a temperature of about 212° F (100° C) at this point. The steaming is stopped, excess water removed from the cylinder and the cylinder quickly filled with solvent (cold) which immediately upon contacting the hot wood boils at the wood surface scouring the surface and aiding in the dissolution of surface matter such as crystalline penta, wood rosin, etc. brought to the surface during the steaming. At least no later than cessation of boiling at the surface the wood is freed from contact with the solvent and any surface film of solvent is vaporized from the equilibrating wood. In the instant instance the cylinder was flushed with live steam to sweep solvent vapors to the condenser and then opened. The wood was clean at this surface, had a natural wood appearance and was free of surface crystals of penta and wood rosin.

In similar fashion it is possible to remove the crystalline penta and wood rosins from the surface of poles treated in other well-known processes such as the Cellon Process of Koppers using Liquid Petroleum Gases (LPG) (U.S. Pat. No. 3,200,003) as the impregnating agent by employing the methylene chloride wash at the end of impregnating solvent removal. Likewise even the Oil-Penta Process and the aqueous Salt Process can produce wood free of surface crystals by simply following the oil recovery or drying steps of the foregoing process with a short immersion of the wood in methylene chloride, for example, until ebullient (surface boiling under liquid) has ceased, then immediately removing the solvent from contact with the wood.

It is to be understood that should the wood be left in the cleanining immersion cycle much longer than the cessation of ebullient boiling that after the solvent has been drained or otherwise removed from contact with the wood, a short or light steaming should be carried out to remove solvent from the surface and the immediate interior of the wood. If the steaming is maintained short a majority of the solvent can be removed without forcing more of the penta or other agent to the surface.

I claim:

1. In a method for removing excess crystalline treating agent from the surfaces of wood and wood products which have been impregnated with a solvent solution of a treating agent, dissolved or dispersed in the solvent, under atmospheric or superatmospheric pressure at from ambient to elevated temperatures up to about 250° C;

freed of the impregnating solution in excess of that impregnated into the wood;

freed of the solvent impregnated into the wood during the impregnation step by contacting the wood with saturated or superheated steam at ambient pressure, until substantially all of the solvent in the wood is removed and recovered; the improvement which consists of:

contacting the hot substantially solvent free wood with liquid solvent for a period of time not greater than the time ebullient boiling of the solvent at the wood's surface cases; and removing the liquid solvent from contact with the wood.

2. In a method for removing excess crystalline treating agent from the surfaces of wood and wood products which comprises impregnating the wood with a solvent solution of the treating agent, dissolved or dispersed in a chlorinated solvent selected from the group consisting of methylene chloride, perchloroethylene, trichloroethylene and 1,1,1a -trichloroethane, under atmospheric or superatmospheric pressure at from ambient to elevated temperatures up to about 250° C;

removing the impregnating solution in excess of that impregnated into the wood from association with the wood;

removing a chlorinated solvent selected from the group consisting of methylene chloride, perchloroethylene, trichloroethylene and 1,1,1-trichloroethane impregnated into the wood during the impregnation step by contacting the wood with saturated or superheated steam at ambient pressure; until substantially all of the solvent in the wood is removed and recovered; the improvement which consists of:

contacting the hot wood with liquid solvent selected from the group consisting of methylene chloride, perchloroethylene, trichloroethylene and 1,1,1trichloroethane for a period of time not greater than the time ebullient boiling of the solvent at the wood's surface ceases; and removing the solvent from contact with the wood.

3. The process of claim 2 wherein the solvent is methylene chloride both for impregnation and later contacting.

4. A method for cleaning excess crystalline treating agent from the surface of wood after impregnation and solvent removal which comprises contacting the wood while still hot from said removal with a liquid chlorinated solvent boiling below the wood temperature to effect ebullient boiling of the solvent at the wood surface below the liquid and removing the liquid solvent at least as soon as ebullient boiling has ceased.

* * * * *

UNITED STATES PATENT AND TRADEMARK OFFICE

CERTIFICATE OF CORRECTION

PATENT NO. : 3,995,078

DATED : November 30, 1976

INVENTOR(S) : William D. Winn

It is certified that error appears in the above-identified patent and that said Letters Patent are hereby corrected as shown below:

Col. 2, line 12, delete "cyliner" and insert --- cylinder ---

Col. 2, line 39, delete "this" and insert --- its ---

Col. 2, line 57, delete "cleanining" and insert --- cleaning ---

Col. 3, line 18, delete "cases" and insert --- ceases ---

Col. 3, line 28, delete "1,1,la-trichloroethane" and insert --- 1,1,1-trichloroethane ---

Col. 4, line 15, insert a hyphen (-) between "1,1,1" and "tri-", as --- 1,1,1-tri- ---

Signed and Sealed this

Twenty-second Day of March 1977

[SEAL]

*Attest:*

RUTH C. MASON
*Attesting Officer*

C. MARSHALL DANN
*Commissioner of Patents and Trademarks*